US011198582B2

(12) United States Patent
Connors et al.

(10) Patent No.: US 11,198,582 B2
(45) Date of Patent: Dec. 14, 2021

(54) PAPER TRAY HOLD DOWN FINGER SYSTEM AND METHOD

(71) Applicant: Toshiba TEC Kabushiki Kaisha, Shinagawa-ku (JP)

(72) Inventors: William M. Connors, Lexington, KY (US); Donn D. Bryant, Lexington, KY (US); Brad W. Towe, Versailles, KY (US)

(73) Assignee: Toshiba TEC Kabushiki Kaisha, Shinagawa-ku (JP)

( * ) Notice: Subject to any disclaimer, the term of this patent is extended or adjusted under 35 U.S.C. 154(b) by 240 days.

(21) Appl. No.: 16/523,614

(22) Filed: Jul. 26, 2019

(65) Prior Publication Data

US 2021/0024319 A1 Jan. 28, 2021

(51) Int. Cl.
*B65H 31/26* (2006.01)
*B65H 31/10* (2006.01)

(52) U.S. Cl.
CPC ..... *B65H 31/26* (2013.01); *B65H 31/10* (2013.01)

(58) Field of Classification Search
CPC ..... B65H 31/26; B65H 31/10; B65H 29/44; B65H 9/06; B65H 2402/341; B65H 2402/342
See application file for complete search history.

(56) References Cited

U.S. PATENT DOCUMENTS

| | | | | |
|---|---|---|---|---|
| 4,068,839 | A * | 1/1978 | Bullock | B65H 29/44 271/180 |
| 7,419,150 | B2 * | 9/2008 | Kushida | B42C 1/12 270/58.07 |
| 2017/0240372 | A1 * | 8/2017 | Hatakawa | B65H 31/10 |
| 2020/0102177 | A1 * | 4/2020 | Nakazawa | B65H 29/125 |
| 2020/0377323 | A1 * | 12/2020 | Nakahata | B65H 31/02 |

* cited by examiner

*Primary Examiner* — Howard J Sanders
(74) *Attorney, Agent, or Firm* — Ulmer & Berne LLP

(57) ABSTRACT

A hold down finger for a finisher process tray contacts the top sheet of paper on a paper tray to prevent subsequently printed pages from disturbing pages disposed on the paper tray. The hold down finger includes gears that move a portion of the hold down finger that contacts the top sheet of paper from a retracted position to a forward hold down position along a substantially elliptical path. After each sheet is printed and placed on top of other pages in the paper tray, the paper tray lowers and the hold down finger continues along the substantially elliptical path back to the retracted position. A rack gear associated with the paper tray engages a cylindrical gear of the hold down finger to return the hold down finger to the retracted position if the paper tray is forced upwards while the hold down finger is in the forward position.

6 Claims, 6 Drawing Sheets

PAPER TRAY HOLD DOWN FINGER SYSTEM AND METHOD

TECHNICAL FIELD

The subject application generally relates to a hold down mechanism for finisher process trays, and more specifically to a retractable paper hold down finger associated with the finisher that selectively holds down the top sheet of paper of a paper tray.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

Finisher assemblies for MFPs include a finisher process tray that ejects printed pages to a movable paper tray that accumulates stacks of the printed pages associated with print jobs. When a printed page is ejected by the finisher process tray, the ejected page may disturb pages that have accumulated on the movable paper tray and lead to a misalignment of printed pages. If the accumulated pages are part of the same print job, disturbed pages would need to be realigned with other pages on the paper tray before additional finishing steps could be undertaken. For example if the print job included instructions to staple together the pages by a stapler assembly at the conclusion of the print job, the pages would need to be realigned prior to stapling or performing additional finishing steps.

BRIEF DESCRIPTION OF THE DRAWINGS

Various embodiments will become better understood with regard to the following description, appended claims and accompanying drawings wherein:

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

In example embodiments, a multifunction printer includes a finisher process tray with retractable hold down fingers that contact the top sheet of paper disposed in a paper accumulation tray. The retractable hold down fingers prevent newly printed sheets from disturbing the sheets of paper in the paper accumulation tray. The retractable hold down finger is moved in a substantially elliptical path or path from a retracted position, to a forward hold down position, and back to the retracted position through a lower position in coordination with movement of the paper accumulation tray during printing of user print jobs. A rack gear associated with the paper tray and a cylindrical gear associated with the hold down finger are configured to move the hold down finger back to the retracted position if the paper accumulation tray is forced upwards while the hold down finger is in the forward hold down position.

Figure 1:
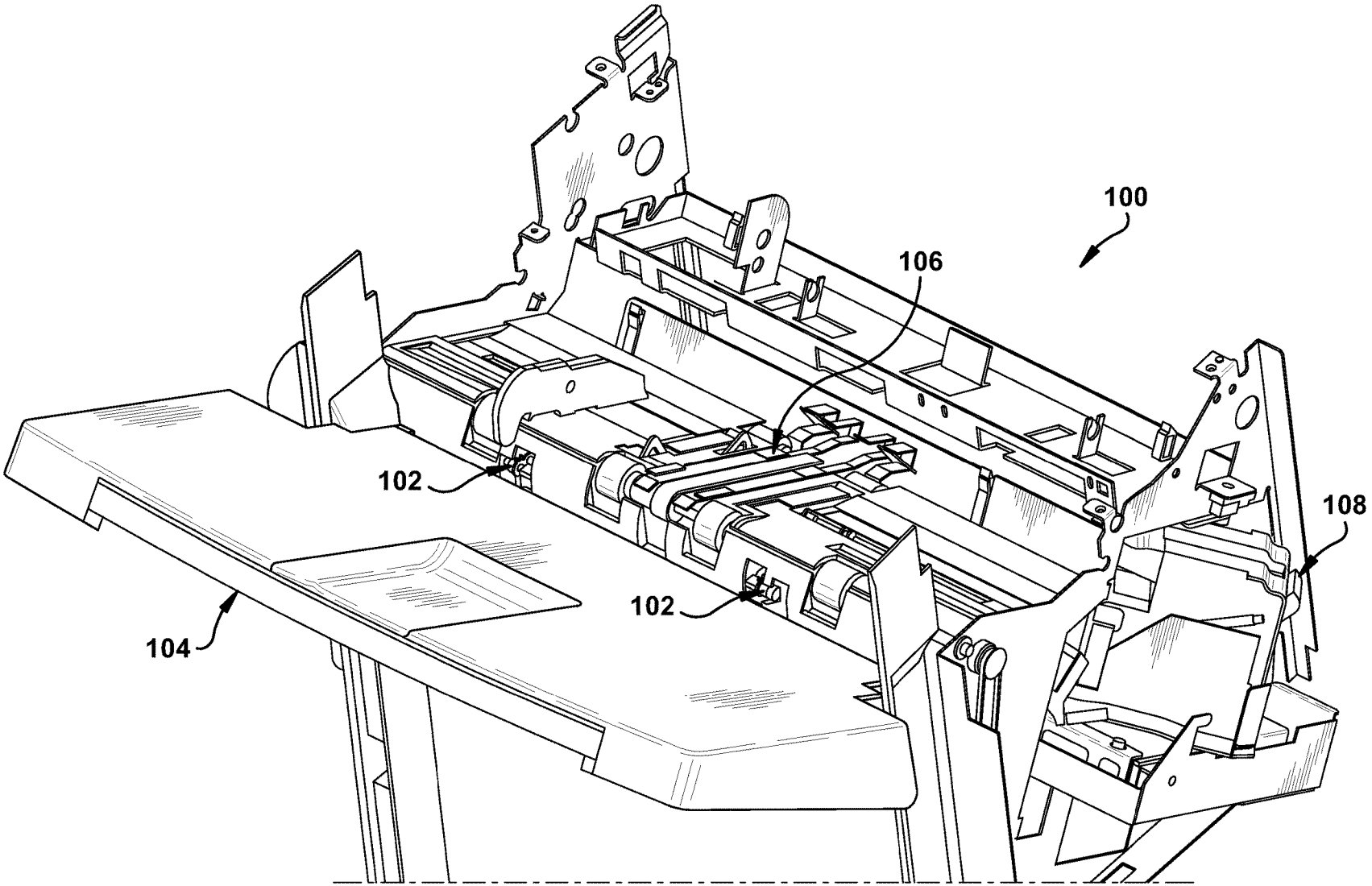
FIG. 1 is a perspective view of a finisher assembly of a multifunction peripheral.

With reference to FIG. 1, an example finisher assembly 100 of a multifunction peripheral is presented. The finisher assembly 100 includes paper hold down finger assemblies 102, a movable paper tray 104 or paper accumulation tray, a finisher process tray 106, and optionally a stapler assembly 108. The finisher assembly 100 can include other document processing assemblies such as a hole punch assembly (not shown), paper folding assembly (not shown), and so forth.

During print operations, the finisher process tray 106 ejects individual printed pages to the paper tray 104, where the printed pages are accumulated. When printed pages are ejected from the finisher process tray 106 to the paper tray 104, frictional forces between the pages can cause a newly ejected page to disturb the position of one or more printed pages currently accumulated in the paper tray 104. When this happens, pages stacked in the paper tray 104 can become misaligned relative to one another. If there is further processing to be performed to the print job, such as stapling the pages together with the stapler assembly 108, the pages can be misaligned resulting in a print job that might have to be discarded and reprinted, or manually corrected.

To prevent an ejected page from disturbing the positions of previously printed pages stacked on the movable tray, the paper hold down finger assemblies 102 hold down the top sheet of paper in the movable tray prior to the next page being ejected from the finisher process tray 106. The paper tray 104 is lowered prior to accepting the next sheet of paper and the paper hold down finger assemblies 102 are retracted, allowing the newly printed page to become the new top sheet, after which the hold down finger assemblies 102 move forward to hold down the new top sheet as the next printed page is ejected from the finisher process tray 106. As additional pages are printed, the process is repeated until the last page of the print job is printed.

Figure 2:
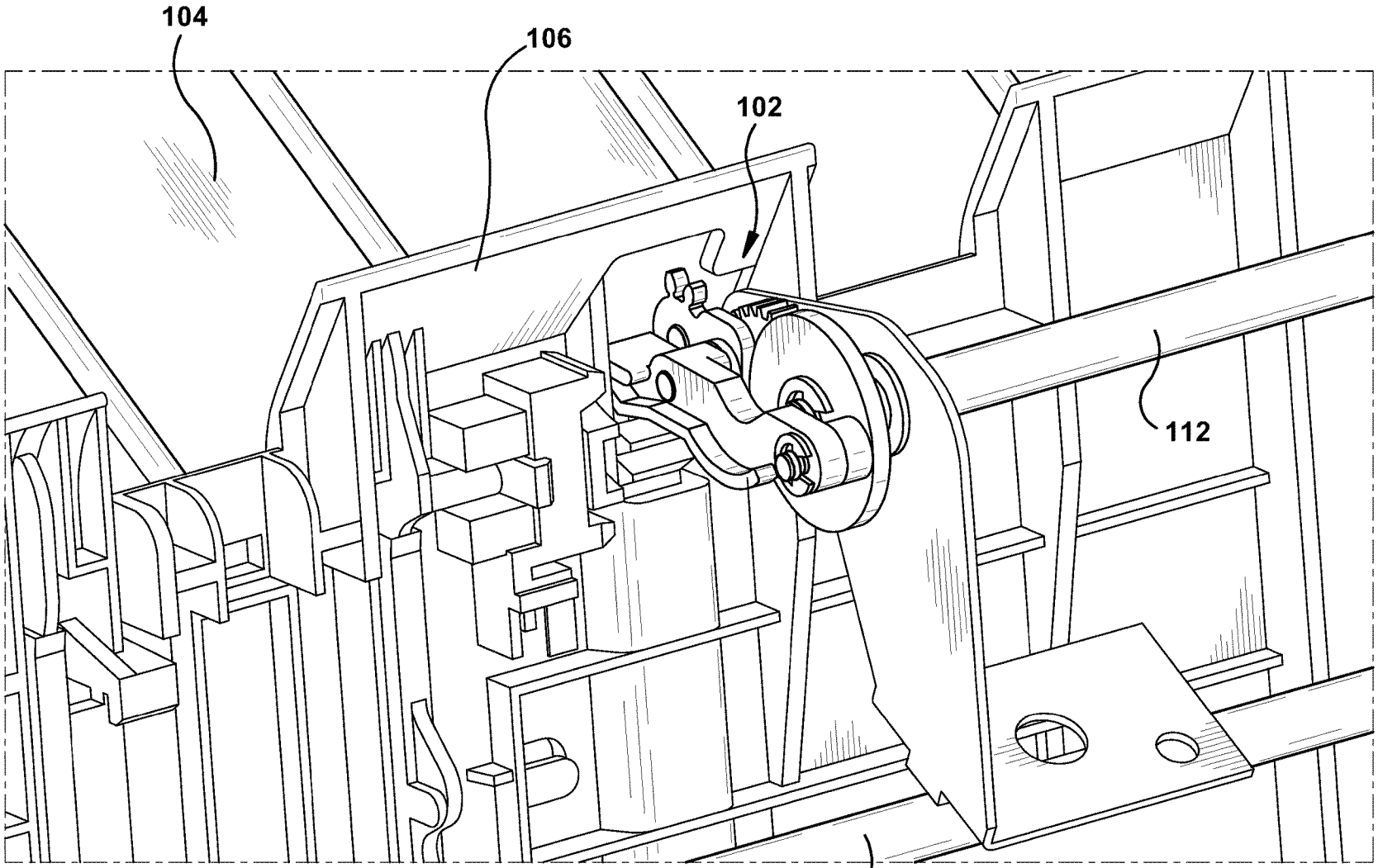
FIG. 2 is a rear perspective view of a hold down finger assembly of a multifunction peripheral.

With reference to FIG. 2A, a rear view of an example hold down finger 102 is presented. During print operations, the hold down finger 102 extends through an opening in the finisher process tray 106 towards the paper tray 104. The hold down finger assembly 102 is driven by an auxiliary drive shaft 112 that is coupled to the primary drive shaft 110.

Figure 3A:
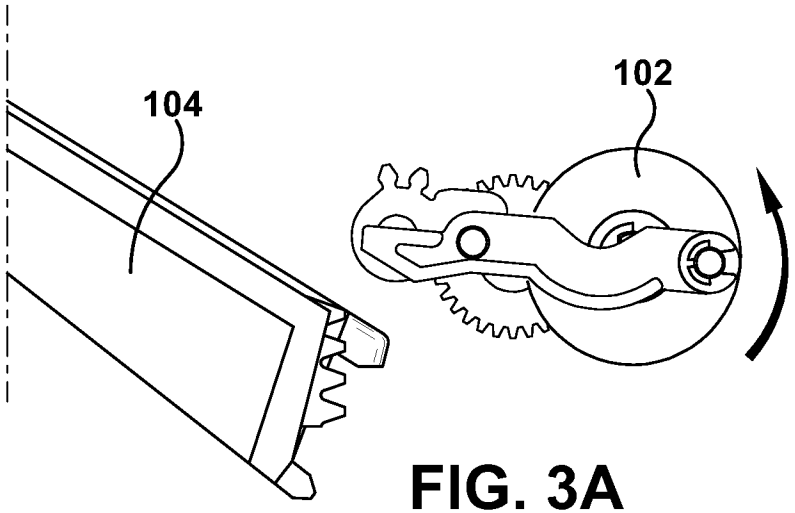
FIG. 3A is a side view of a hold down finger assembly of a multifunction peripheral in a retracted position.
Figure 3B:
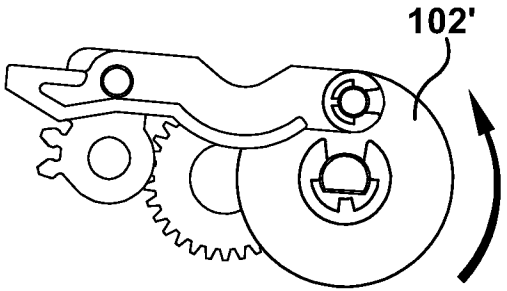
FIG. 3B is a side view of a hold down finger assembly of a multifunction peripheral in an upper position.
Figure 3C:
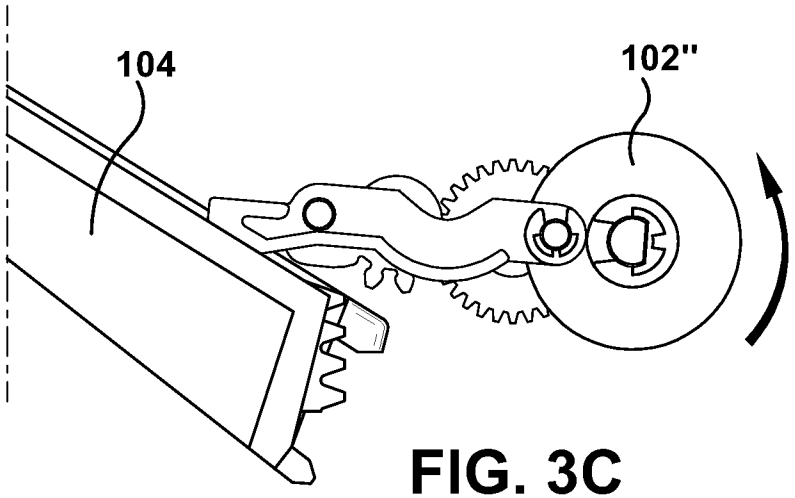
FIG. 3C is a side view of a hold down finger assembly of a multifunction peripheral in a forward position.
Figure 3D:
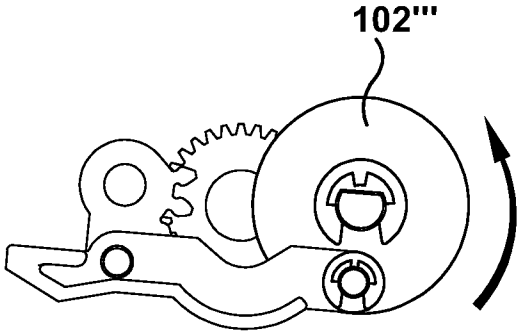
FIG. 3D is a side view of a hold down finger assembly of a multifunction peripheral in a lower position.

With reference to FIGS. 3A-3D, side views of the hold down finger 102 are presented in various selected positions relative to the paper tray 104. In FIG. 3A, the hold down finger 102 is shown in the retracted position. Except during print operations, the hold down finger 102 normally rests in the retracted position. As illustrated in FIG. 3B, once a page has been printed, rotation of gears (see gears 124, 126, and 128 of FIG. 5 and associated description) associated with the hold down finger 102' move the hold down finger 102' into the upper position. As illustrated in FIG. 3C, further rotation of the gears results in the hold down finger 102" transitioning into the forward position, where a portion of the hold down finger 102" presses down on the top sheet of paper in the paper tray 104. At this point, a newly printed page can be ejected onto the top sheet of paper of the paper tray 104 without disturbing the position of the top sheet of paper which is held down by the hold down finger 102". As illustrated in FIG. 3D, after the page is printed the hold down finger 102'" can be rotated to the lower position without contacting the paper tray 104 which is lowered prior to the next page being printed. Further rotation of the gears results in the hold down finger 102 returning to the retracted position of FIG. 3A. As illustrated in FIGS. 3A-3D, rotation of the gears moves the portion of the hold down finger 102 that contacts the top sheet of paper in the paper tray 104 in a substantially elliptical path, or track, from the retracted position, through the upper position to the forward hold down position, and back to the retracted position through the lower position.

Figure 5:
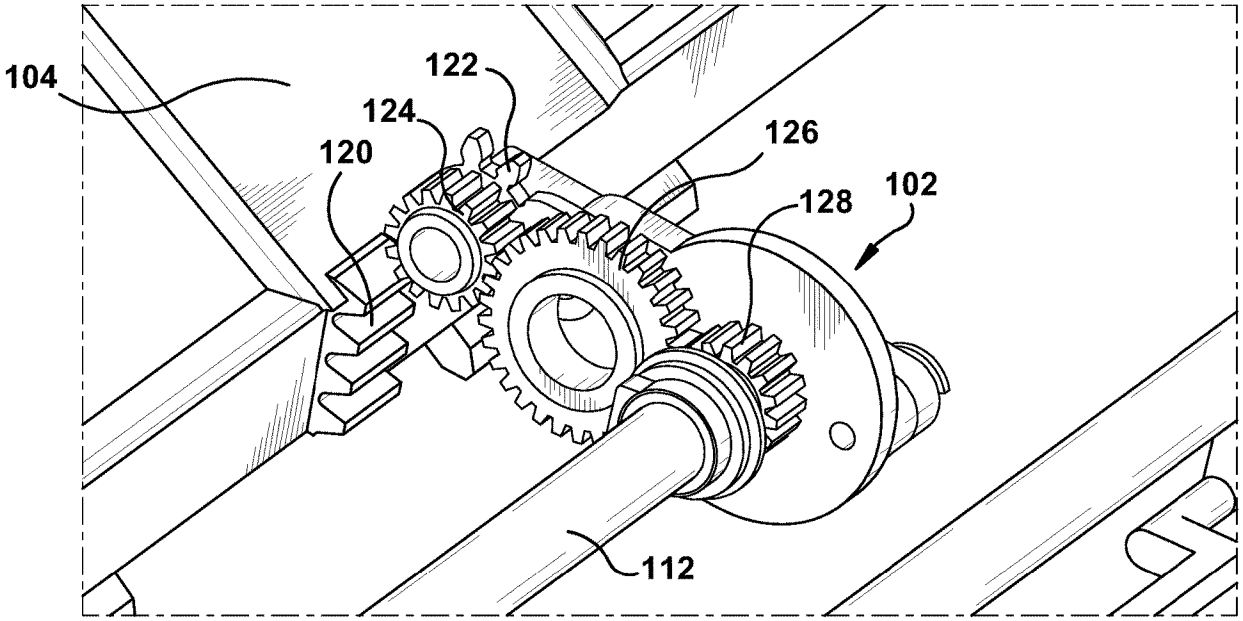
FIG. 5 is a perspective view of the movable tray and hold down finger assembly of a multifunction peripheral.
Figure 4:
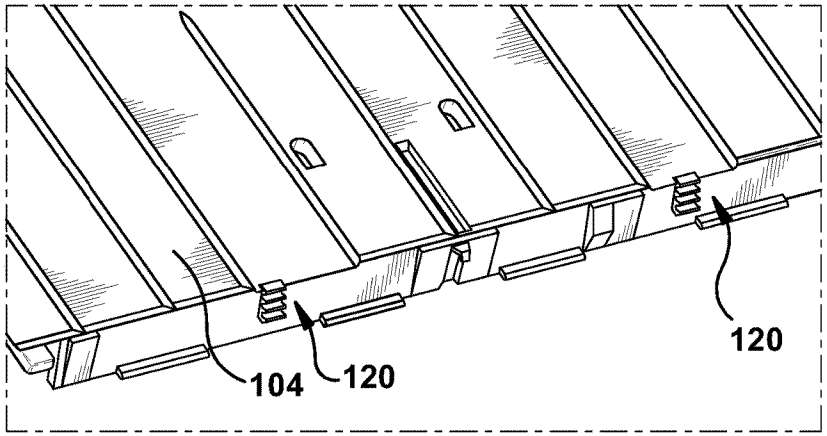
FIG. 4 is a perspective view of the movable tray of a multifunction peripheral.

Referring now to FIGS. 4 and 5, in certain embodiments the paper tray 104 includes a gear rack 120 configured to mesh with a cylindrical gear 122 of the hold down finger 102. The gear rack 120 and cylindrical gear 122 engage to retract the hold down finger 102 if the paper tray 104 is forced up while the hold down finger 102 is in the forward position as illustrated with regard to FIGS. 6A-6D. In certain embodiments, the cylindrical gear 122 can be configured to engage paper stacked on the paper tray 104 in order to move the hold down finger 120 into the retracted position when a large print job is in the paper tray 104.

Figure 6B:
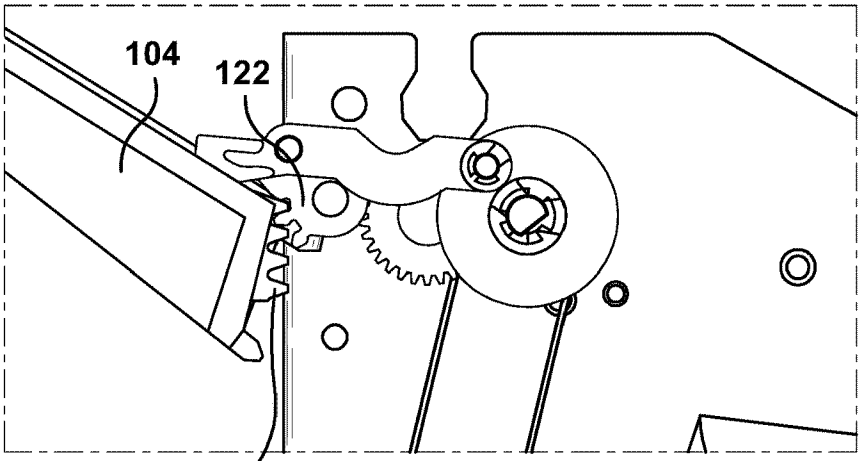
FIG. 6B is a side view of a movable tray and a hold down finger assembly of a multifunction peripheral in an initial pushed up position.
Figure 6A:
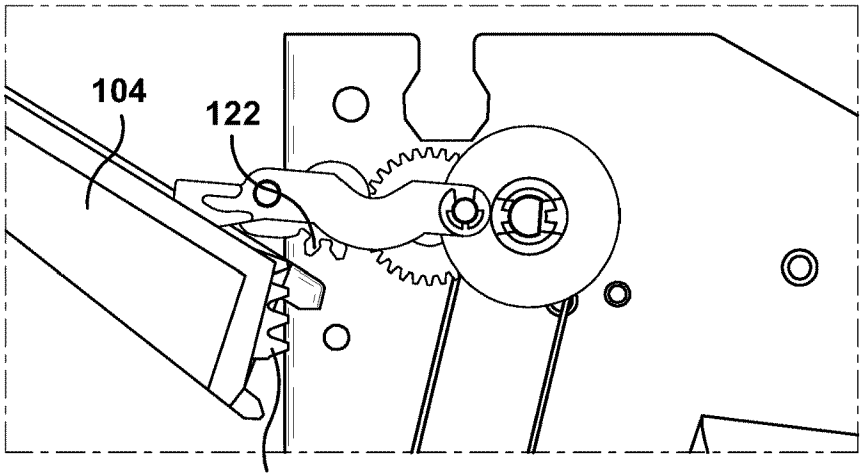
FIG. 6A is a side view of a movable tray and a hold down finger assembly of a multifunction peripheral in a forward position.

FIG. 6A illustrates the hold down finger 102 in the full forward position where the hold down finger 102 presses against a top sheet of paper on the paper tray 104, for example as illustrated in FIG. 3C above. In normal operation, the cylindrical gear 122 does not engage with the gear rack 120 of the paper tray 104.

FIG. 6B illustrates that if the paper tray 104 is moved upwards while the hold down finger 102 is in the full forward position, then after a short movement upward by the paper tray 104, the cylindrical gear 122 begins to engage with the gear rack 120. This condition might occur for example, when a user of the printer inadvertently bumps against the paper tray 104 or if a fault condition of the paper tray 104 occurs.

Figure 6D:
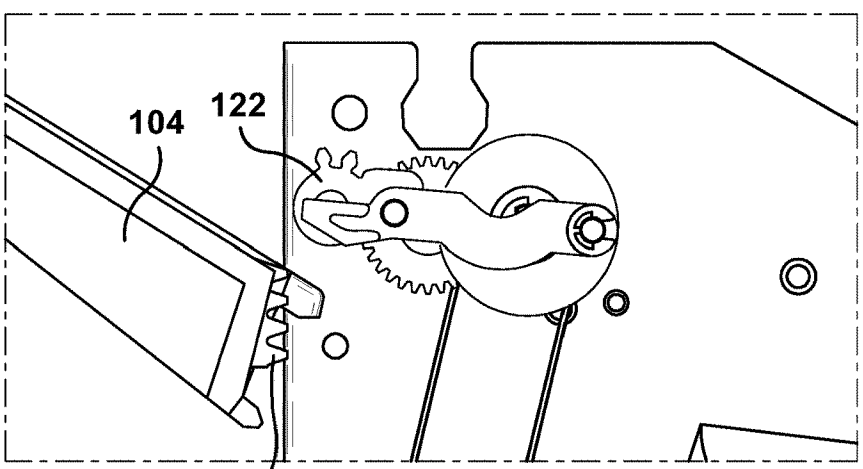
FIG. 6D is a side view of a movable tray and a hold down finger assembly of a multifunction peripheral in a retracted position.
Figure 6C:
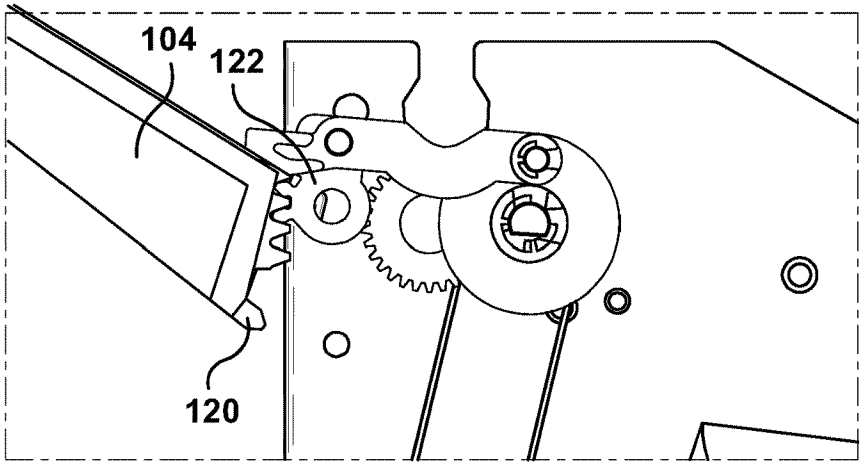
FIG. 6C is a side view of a movable tray and a hold down finger assembly of a multifunction peripheral in a pushed up position.

FIG. 6C illustrates that as the paper tray 104 continues to be pushed upwards, the cylindrical gear 122 meshes with the gear rack 120 and rotates the gears 124, 126, 128 and the auxiliary drive shaft 112. The gears 124, 126, 128 rotate in the opposite direction than what occurs as described above with regards to FIGS. 3A-3C when the gears 124, 126, 128 are driven by the motor. When the cylindrical gear 122 rotates relative to the gear rack 120, the hold down finger 120 is moved through the upward position and returned to the retracted position as illustrated in FIG. 6D. The hold down finger 120 is moved in the opposite direction along the elliptical path as what is illustrated for the hold down finger 120 in FIGS. 3A and 3B.

FIG. 6D illustrates the hold down finger 120 in the retracted position. The paper tray 104 can be freely moved without contacting the hold down finger 120. The retraction design of the gear rack 120 and cylindrical gear 122 safely retracts the hold down finger 120 in the event that the paper tray 104 is unexpectedly moved upwards while the hold down finger 120 is not already in the retracted position. This protects the paper tray 104, the hold down finger 120 and the gears 124, 126, 128 as well as other components from potentially being damaged if the moveable tray 104 moves upward when the hold down finger 120 is in the forward position.

Figure 7:
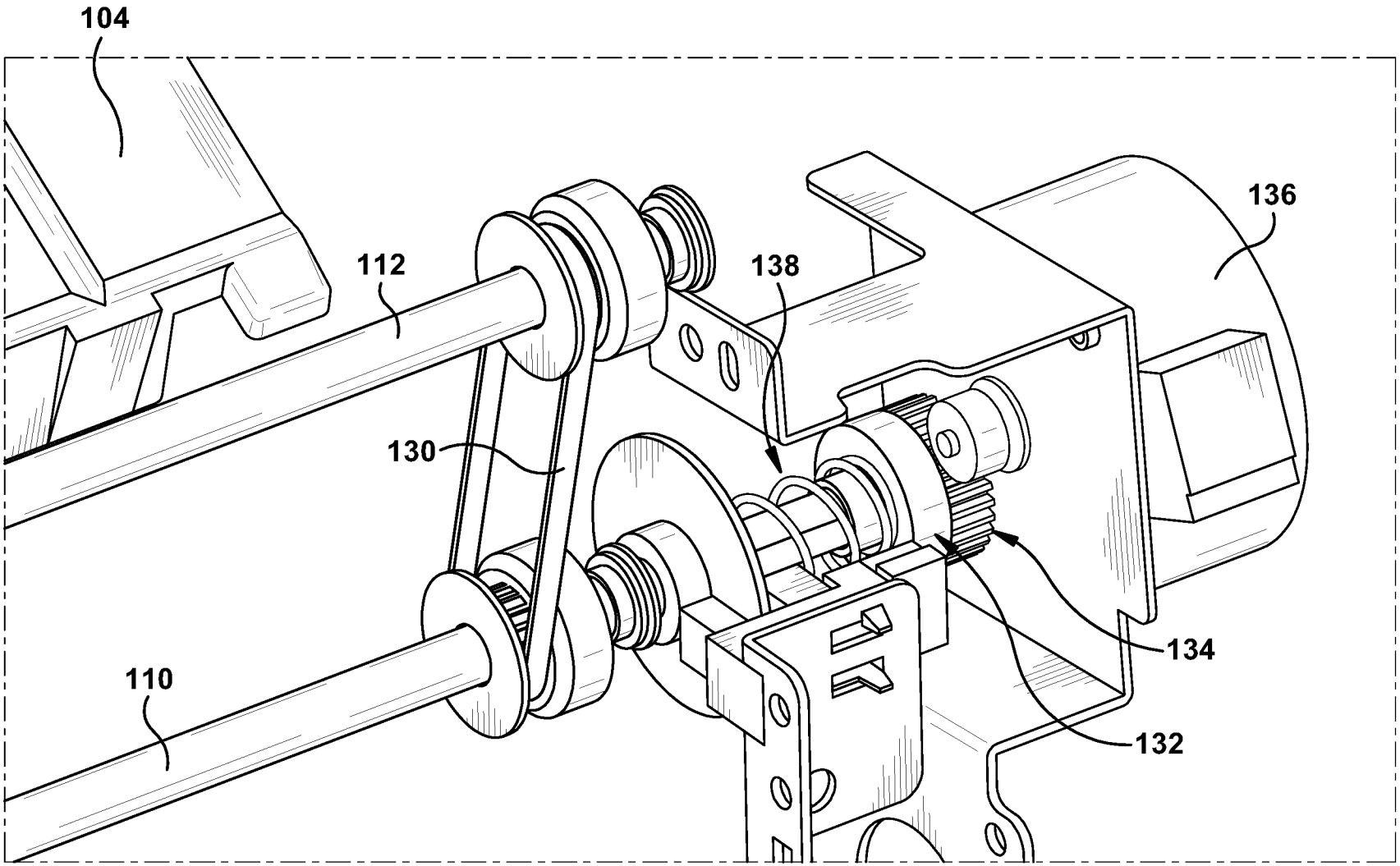
FIG. 7 is a perspective view of a drive assembly of a hold down finger assembly of a multifunction peripheral.

Referring also to FIG. 7, the drive assembly of the hold down finger assembly is illustrated. The drive assembly includes a motor 136 that drives a driven gear 134 when activated. The driven gear 134 is coupled to the drive shaft 110 via a drive coupling 132 and spring 138. The motor 136 is normally engaged with the drive shaft 110 via the drive coupling 132. The drive coupling 132 and spring 138 function as a slip clutch such that when the drive torque on the drive shaft 110 rises above a designated limit, the drive coupling 132 will disengage from the driven gear 134 allowing the drive shaft 110 to slip relative to the driven gear 134 and motor 136. For example, if the hold down finger 120 is rotated into the retracted position when the paper tray 104 is moved upwards, as described above with regard for FIGS. 6B-6D, then the torque of gears 124, 126, and 128 rotating in the opposite direction is applied to the auxiliary drive shaft 112 and will be coupled to the drive shaft 110 via a belt 130 and the drive shaft 110 can slip as describe above. Although the auxiliary drive shaft 112 is illustrated as being directly coupled to the gears 122, 124, 126, 128 and also being coupled to the drive shaft 110 via a belt 130, any means of communicating rotation from the motor to the gears 122, 124, 126, 128 can be used including one or more drive shafts, belts, gears, and so forth as would be understood in the art. The term communication should be interpreted as any means for directly or indirectly transferring forces between elements, including but not limited to rotational forces such as torque being communicated between two elements through one or more intermediary elements.

In light of the foregoing, it should be appreciated that the present disclosure significantly advances the art of hold down fingers of finisher process trays. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An apparatus, comprising:

a movable paper tray, of a printer, configured to receive a plurality of printed pages;

a rack gear associated with the paper tray;

a finisher process tray, of the printer, configured to eject printed pages to the paper tray;

a retractable hold down finger, associated with the finisher process tray, configured to selectively hold down at least a top sheet of paper disposed on the paper tray; and a cylindrical gear associated with the retractable hold down finger and configured to engage with the rack gear when the paper tray is moved upwards;

wherein at least a portion of the retractable hold down finger that contacts the top sheet of paper is configured to rotate in a substantially elliptical path in coordination with movement of the paper tray during printing of the plurality of printed pages, and wherein when the paper tray is moved upwards, the cylindrical gear and rack gear move the retractable hold down finger into a retracted position.

2. The apparatus of claim 1, further comprising:

a second retractable hold down finger configured to selectively hold down at least the top sheet of paper disposed on the paper tray.

3. The apparatus of claim 1, further comprising:

a plurality of gears associated with the retractable hold down finger and configured to move the portion of the retractable hold down finger that contacts the top sheet of paper in the substantially elliptical path.

4. The apparatus of claim 3, further comprising:

a motor associated with the finisher process tray;

a drive shaft configured to be rotated by the motor; and a drive coupling configured to selectively disengage the motor from the drive shaft, wherein the plurality of gears associated with the retractable hold down finger are in communication with the drive shaft, and wherein the drive coupling selectively disengages the motor from the drive shaft based at least in part on torque communicated from the plurality of gears to the drive shaft when the plurality of gears are rotated in a reverse direction than when rotated by the drive shaft.

5. The apparatus of claim 1, wherein the cylindrical gear and rack gear are configured to rotate the portion of the retractable hold down finger that contacts the top sheet of paper in a reverse direction along the substantially elliptical path to move the retractable hold down finger into the retracted position.

6. The apparatus of claim 1, further comprising:

a motor associated with the finisher process tray;

a drive shaft configured to be rotated by the motor; and a drive coupling configured to selectively disengage the motor from the drive shaft, wherein the cylindrical gear is in communication with the drive shaft, and wherein when the portion of the retractable hold down finger is rotated in the reverse direction, torque communicated from the cylindrical gear to the drive shaft causes the drive coupling to disengage the drive shaft from the motor.

* * * * *